United States Patent [19]

Seanor

[11] 4,078,285

[45] Mar. 14, 1978

[54] HARD ALLOY FUSER MEMBERS

[75] Inventor: Donald A. Seanor, Pittsford, N.Y.

[73] Assignee: Xerox Corporation, Stamford, Conn.

[21] Appl. No.: 736,642

[22] Filed: Oct. 28, 1976

[51] Int. Cl.[2] ..... B21B 31/08

[52] U.S. Cl. ..... 29/132

[58] Field of Search ..... 29/132, 129.5, 130; 118/60, 70

[56] References Cited

U.S. PATENT DOCUMENTS

| | | | |
|---|---|---|---|
| 2,999,766 | 9/1961 | Ashworth et al. | 29/130 X |
| 3,224,897 | 12/1965 | Smith | 118/60 X |
| 3,945,723 | 3/1976 | Cook | 29/130 X |
| 3,965,853 | 6/1976 | Moser | 118/60 |
| 4,000,957 | 1/1977 | Ruhland | 118/60 X |
| 4,011,362 | 3/1977 | Stewart | 29/132 X |

*Primary Examiner*—Alfred R. Guest

*Attorney, Agent, or Firm*—James J. Ralabate; Ernest F. Chapman

[57] ABSTRACT

Fuser members having hard, abrasion resistant bare metal alloy surfaces which are chemically reactive, are described for fuser assemblies in office copier machines. Preferred fuser assemblies include cylindrical rolls having at least an outer surface of a chemically reactive copper alloy.

15 Claims, No Drawings

HARD ALLOY FUSER MEMBERS

BACKGROUND OF THE INVENTION

This invention relates generally to rolls utilized for pressure fusing toners at elevated temperatures, and more particularly to a roll which will prevent offsetting of toner onto the roll during the fusing operation.

In the process of xerography a light image of an original to be copied is typically recorded in the form of a latent electrostatic image upon a photosensitive member with subsequent rendering of the latent image visible by the application of electroscopic particles, commonly referred to as toner. The visual toner image can be either fixed directly upon the photosensitive member or transferred from the member to another support, such as a sheet of plain paper, with subsequent affixing of the image thereto. Toners are well known in the art and may be of various types.

In order to affix or fuse electroscopic toner material onto a support surface permanently by heat, it is necessary to elevate the temperature of the toner material to a point at which the constituents of the toner material coalesce and become tacky. This action causes the toner to flow to some extent into the fibers or pores of support members or otherwise upon the surface thereof. Thereafter, as the toner material cools, solidification of the toner material occurs causing the toner material to be bonded firmly to the support member. In both the xerographic as well as the electrographic recording arts, the use of thermal energy for fixing toner images onto a support member is old and well known.

Several approaches to thermal fusing of electroscopic toner images onto a support have been described in the prior art and include providing the concomitant application of heat and pressure as by a roll pair maintained in pressure contact, a flat or curved plate member in pressure contact with a roll, a belt member in pressure contact with a roll, and the like. Heat may be applied by heating one or both of the rolls, plate members or belt members. The fusing of the toner takes place when the proper combination of heat, pressure and contact time are provided, the balancing of these parameters being well known in the art and varying according to various factors which must be independently determined for each particular situation.

During operation of a fusing system of the type where there is a thermal fusing of electroscopic toner images onto a support in which at least one fuser member, such as a roll, plate or belt, is heated, the support member to which the toner images are electrostatically adhered, is moved through the nip formed between the members with the toner image pressure contacting the fuser roll thereby to effect heating of the toner images within the nip. By controlling the heat transfer to the toner, virtually no offset of the toner particles from the copy sheet to the fuser member is experienced under normal conditions. This is because the heat applied to the surface of the fuser member is insufficient to raise the temperature of the surface of the member above the "hot offset" temperature of the toner at which temperature the toner particles in the image areas of the toner liquify and cause a splitting in the molten toner resulting in "hot offset." Splitting occurs when the cohesive forces holding the viscous toner mass together is less than the adhesive forces tending to offset it to a contacting surface such as a fuser roll, fuser belt, or fuser plate.

Occasionally, however, toner particles will be offset to the fuser roll by an insufficient application of heat to the surface thereof (i.e., "cold" offsetting); by imperfection in the properties of the surface of the roll; by the toner particles insufficiently adhering to the copy sheet; by the electrostatic forces which normally hold them there; or by the reactivity of the toner material itself in those cases where the toner is of a reactive nature. In such a case, toner particles may be transferred to the surface of the fuser member with subsequent transfer to the backup member which provides provides pressure contact, during periods of time when no copy paper is in the nip.

One arrangement for minimizing the foregoing problems, particularly that which is commonly referred to as "offsetting," has been to provide a fuser member with an outer surface or covering of polytetrafluoroethylene, known by the tradename Teflon, to which a release agent such as silicone oil is applied. More recently, bare metal fuser members have been introduced for fusing or fixing the electroscopic toner materials to various surfaces. Various fluid polymer release materials which oxidize or which contain functional groups can be utilized to prevent "offsetting." Exemplary of such systems are disclosed in U.S. Pat. No. 3,937,637 and U.S. Pat. No. 3,918,804. Other release agents for bare metal fuser rolls are described in Belgium Pat. No. 831,662.

Typical materials heretofore proposed for bare metal fuser rolls includes anodized aluminum and alloys thereof, steel, stainless steel, nickel and alloys thereof, steel, stainless steel, nickel and alloys thereof, nickel plated copper, chrome plated copper and glass. Generally, copper is superior as a bare metal fuser member material because it has desirable release characteristics when used with certain release fluids. However, the life of bare copper fuser rolls is limited due to the softness and other properties of the copper. Accordingly, when bare metal copper rolls are used in a fuser system, excessive wear rates and the tendency of the bare metal copper roll to receive gouges, nicks and other deformities, necessitate the frequent replacement of the bare metal copper fuser rolls, resulting in uneconomical disadvantage because of replacement cost and machine down time.

OBJECTS OF THE INVENTION

Accordingly, it is the principal object of this invention to provide a new and improved bare metal fuser member for use in fuser assemblies in xerographic copying machines.

Another object of this invention is to provide a new and improved fuser roll for use in a fuser assembly in xerographic copying machines.

Another object of this invention is to provide a fuser assembly having an improved bare metal fuser roll for use with polymer release materials which oxidize or which contain functional groups for the prevention of offsetting when the bare metal fuser roll is used to fuse xerographic toners to suitable substrates.

SUMMARY OF THE INVENTION

The above-cited objects of the present invention are accomplished by a bare metal fuser member for pressure fusing toned electrostatic images at elevated temperatures, the fuser member having improved resistance to wear and using fluid polymer release materials having reactive functionality with the metal of the fuser member to reduce toner offset by forming a base member having a working surface of hard, abrasion resistant metal alloy, said metal alloy being the type which is chemically reactive and thereby permits the formation of a barrier layer when fluid polymer release materials having reactive functionality are used thereon.

Preferred fuser assemblies include cylindrical rolls, flat plates, curved plates, belts and the like having at least an outer surface of a copper-containing alloy. The copper-containing alloy of the fuser members are those which in the presence of the reactive polymer release material, namely, those polymer release materials which oxidize or which contain functional groups, interact therewith when applied thereto as release fluids so that the essentially bare metal copper alloy can be used to fuse xerographic toners to suitable substrates.

In accordance with the present invention, an alloy includes a solid mixture of two or more metals; two or more metals having certain non-metallic elements fused therein; the impregnation of at least one metal into the surface of another metal; and the like. To form the metal at least upon the surface of the base member, the particular alloy may be flame/plasma sprayed, electroplated, welded, a sleeve force fit upon a base member, and the like, and the base member itself may comprise the alloy and under such circumstances the surface thereof comprises the reactive metal alloys used in accordance with the present invention.

As used herein, "reactive" metal alloy is defined as an alloy which has sufficient chemical reactivity to form a barrier layer when polymer release materials which oxidize or which contain functional groups, are placed upon the surface of the alloy especially at operating temperatures. The metal alloy is said to interact with the polymer release materials which oxidize or which contain functional groups. Operating temperatures are generally from about 200° to about 550° F. In view of the foregoing, the corrosion-resistant alloys designed for use in corrosive environments under conditions of high chemical and mechanical stress do not fall within this category because their chemical reactivity is low. Only those metal alloys having a chemical reactivity greater than that of generally corrosion-resistant alloys as well as reactivity which permits interaction with the reactive polymer release materials described above, are suitable for metal alloys of the present invention.

These as well as other objects of the invention and further features thereof will be better understood upon reference to the following detailed description of the invention.

DESCRIPTION OF THE PREFERRED EMBODIMENTS

The fuser embodiments of the present invention may be used in an automatic xerographic reproducing machine, such as the automatic xerographic reproducing machine, such as the automatic machine described in U.S. Pat. No. 3,937,637, said patent being incorporated herein by reference. Therein is illustrated a reproducing machine which employs an image recording drum-like member, the outer periphery of which is coated with a suitable photoconductive material. One type of photoconductive material is disclosed in U.S. Pat. No. 2,970,906 issued to Bixby in 1961. The photoconductive drum is suitably journaled for rotation within a machine frame by means of a shaft which rotates to bring the image retaining surface thereon past a plurality of xerographic processing stations. Suitable drive means are provided to power and coordinate the motion of the various cooperating machine components whereby a faithful reproduction of the original input scene information is recorded upon a sheet of final support material such as paper or the like.

Since the practice of xerography is well known in the art, the various processing stations for producing a copy of an original are represented as stations A to E. Initially, the drum moves the photoconductive surface through a charging station A. At charging station A an electrostatic charge is placed uniformly over the photoconductive surface of the drum preparatory to imaging. The charging may be provided by a corona generating device of a type described in U.S. Pat. No. 2,836,725 issued to Vyverberg in 1958.

Thereafter, the drum is rotated to exposure station B where the charged photoconductive surface is exposed to a light image of the original input scene information, whereby the charge is selectively dissipated in the light exposed regions to record the original input scene in the form of a latent electrostatic image. A suitable exposure system may be provided by one skilled in the art.

After exposure the photoconductive drum rotates the electrostatic latent image recorded on the photoconductive surface to development station C, wherein a conventional developer mix is applied to the photoconductive surface rendering the latent image visible. A suitable development station may include a magnetic brush development system utilizing a magnetizable developer mix having carrier granules and toner comprising electrophotographic resin plus colorant from dyes or pigments. A developer mix is continually brought through a directional flux field to form a brush thereof. The electrostatic latent image recorded on the photoconductive surface is developed by bringing the brush of developer mix into contact therewith. The developed image on the photoconductive surface is then brought into contact with a sheet of final support material within a transfer station D and the toner image is transferred from the photoconductive surface to the contacting side of a final support sheet. The final support material may be plain paper, gummed labels, transparencies such as polycarbonate, polysulfone and Mylar, etc., as desired.

After the toner image has been transferred to the sheet of final support material, the sheet with the image thereon is advanced to a suitable fuser assembly which fuses the transfer powder image thereto. After the fusing process, the final support material is advanced by a series of rolls 16 to a copy paper tray 17 for subsequent removal therefrom by a machine operator.

Although most of the toner powder is transferred to the final support material, some residual toner remains on the photoconductive surface after the transfer of the toner powder image to the final support material. The residual toner particles remaining on the photoconductive surface after the transfer operation are removed from the drum as it moves through cleaning station E. Here the residual toner particles may first be brought under the influence of a cleaning corona generating device adapted to neutralize the electrostatic charge remaining on the toner particles. The neutralized toner particles are then mechanically cleaned from the photoconductive surface by conventional means as for example, the use of a resiliently biased knife blade. Other cleaning modes may be used at cleaning station E as desired by one skilled in the art.

It is believed that the foregoing description is sufficient for purposes of present application to illustrate the general operation of an automatic xerographic copier which can embody the teachings of the present invention.

As discussed above, fuser assemblies include cylindrical rolls, flat plates, curved plates, belts and the like having at least an outer surface of a hard, abrasion resistant metal alloy, such as a copper-containing alloy, however, for ease of description and applicable to all fuser members, emphasis herein is directed to a fuser assembly having a roll structure as a fuser member. The method of providing the necessary heat is not critical in the use of the special alloys of this invention and the fuser members can be heated by internal means, external means or both, all heating means being well known in the art for providing sufficient heat to fuse toner to its substrate.

A preferred fuser assembly comprises a heated roll structure as described in U.S. Pat. No. 3,937,637 issued to Moser and Ruhland. The heated roll structure includes a hollow cylinder or core having a suitable heating element disposed in the hollow portion thereof which is coextensive with the cylinder. The heating element may comprise any suitable type heater for elevating the surface temperature of the cylinder to operational temperatures therefor, 250°–400° F. For example, it may be a quartz lamp. It is critical that the cylinder surface be fabricated from a hard, abrasion resistant metal alloy, and more preferably from a copper-containing alloy. Any substrate may be used as a core to support the outer surface of copper containing alloy as long as the copper-containing alloy is suitably affixed thereto and can withstand the pressures, heat and other rigorous conditions concomitant in the operation of the fuser assembly. For example, the core or base member in those modes where the fuser member is non-cylindrical, may be steel, stainless steel, copper, nickel, aluminum and the like or the core or base member can be made of the copper alloy material itself.

In one working embodiment, the resulting structure has an outside diameter on the order of 1.5 to 3.0 inches and has a length on the order of 10 to 15 inches. Power requirements for the foregoing are 500–2500 watts peak power with an average power of 300–2000 watts and 75–250 watts for standby. The surface temperature of the fuser member structure may be controlled by contacting the surface thereof with a thermistor probe as described in U.S. Pat. No. 3,327,096, issued to Bernous.

The fuser assembly may further comprise a backup roll structure which cooperates with the fuser roll structure to form a nip through which a copy paper or substrate passes such that toner images thereon contact the fuser roll structure. The backup roll structure may comprise any suitable construction, for example, a steel cylinder, but preferably comprises a rigid steel core having a Viton elastomer surface or layer thereon. A preferred backup roll has a core approximately 1.8 inches in diameter with a 0.1 inch cover or layer structure of Viton elastomer or other suitable high temperature elastomeric layer structure, for example, silicone rubber and a combination of Viton or silicone rubber with Teflon thereon. Viton is the trademark of Dupont Co. The specific dimensions of the members making up the backup roll will be dictated by the requirements of the particular copying apparatus wherein the fuser assembly is employed, the dimensions being greater or less depending upon the process speed of the machine.

The working surface of the fuser member comprising hard, abrasion resistant metal alloys, such as the copper-containing alloys are relatively high surface energy materials, consequently, hot toner material contacting such surfaces would readily wet the surface of the fuser member. Accordingly, there may be provided a release material to prevent offsetting of the toner, especially heated or molten toner, to the bare alloy metal. These release materials are well-known in the art and include the polymer release materials which oxidize and react with the metal alloy surface of the fuser member, exemplary of which are those described and claimed in U.S. Pat. No. 3,937,637. Other fluid polymer release materials include those which have reactive functionality and react with the metal alloy of the working surface of the fuser member. Typical of these polymer release materials which have reactive functionality are the polyorganosiloxanes having functional carboxy groups as described in U.S. Ser. No. 491,432, filed July 24, 1974, polyorganosiloxanes having functional mercapto groups as described in U.S. Ser. No. 491,412 filed July 24, 1974, and other polymer fluids as described in U.S. Ser. No. 491,415, filed July 24, 1974, now U.S. Pat. No. 4,029,827 all assigned to the instant assignee and incorporated herein by reference. In the foregoing disclosures the referenced polymer materials having designated functional groups are applied to a heated fuser member in an electrostatic reproducing apparatus to form thereon a thermally stable, renewable, self cleaning layer having excellent toner release properties for electroscopic thermoplastic resin toners. The polyorganosiloxane fluids and other polymeric fluids having functional carboxy groups interact with the metal fuser member in such a manner as to form an interfacial barrier at the surface of the bare metal fuser member while leaving an unreacted low surface energy release fluid as an outer layer or film. The interfacial barrier is strongly attached to the bare metal fuser member surface and prevents toner material from contacting the outer surface of the fuser member. The material on the surface of the fuser member can be a minimal thickness and thereby represent a minimal thermal barrier.

As used herein, "working surface" of the fuser member, is that surface which contacts the toner to cause the toner to fuse to the substrate upon which it is to be affixed permanently, for example, paper. Thus, the hard, abrasion resistant metal alloys of this invention, for example, the copper-containing alloys, must be those which are chemically reactive and thereby permit the formation of a barrier layer when polymer release materials having reactive functionality are used thereon. As used herein, that characteristic of the polymer release material applied to the bare copper-containing alloy working surface of the fuser member and designated as "reactive functionality" is defined in the foregoing disclosures, and encompasses those polymers which either oxidize and thereby form a functional group which reacts with the fuser member surface to form the desired toner release layer, or have a built-in functional group or groups which react with the fuser member surface to form the desired toner release layer.

The copper — containing alloys which are chemically reactive, that is, those which are not generally considered corrosion resistant, are the most effective working surfaces for fuser members in accordance with the present invention. Alternatively stated, the copper-containing alloys are deemed chemically reactive if they permit the formation of a toner barrier layer through the interaction of the metal alloy and the polymer release material. While the mechanism is not completely understood, it has been observed that when the polymer release materials having reactive functionality, are applied to the metal alloy surface of a fuser device, there is an interaction (a chemical reaction, coordination complex, hydrogen bonding or other mechanism) between the metal alloy surface of the fuser and the polymer release material having the reactive functionality, so that an interfacial barrier layer comprising the reaction product between the metal alloy of the fuser member and the functional polymer material forms a barrier layer intermediate the metal alloy of the fuser member and the outer layer of polymer release material coating the fuser member. This outer layer may be referred to as the non-reacted release layer, or generally, the release layer. The coating, however formed, has been observed to have a greater affinity for the fuser substrate material than toners and thereby prevents toners from contacting the bare metal fuser, while the release coating provides a material the cohesive force of which is less than the adhesive forces between the heated toner and the substrate to which it is applied, and the cohesive forces of the toner.

Not only do the copper-containing alloys provide superior fuser member working surfaces because they have substantially improved wear life over copper itself, but the copper-containing alloys have unexpectedly excellent release characteristics, and the copper-containing alloys generally have surprisingly improved fusing windows over comparable copper-free alloys, when they are used as working surfaces on fuser members. By "release characteristics" is meant the ability to release heated or molten toner from the surface of the fuser member to thereby prevent hot offset, a characteristic failure of fuser members well-known in the art. For example, hot offset tests are performed by visually determining if the toner image is transferred from the substrate to which it is to be fused, to the fuser member itself, or to the next substrate passing through the fuser member, or to the pressure or backup member or roll, or any combination of the foregoing.

Release failure is related to the splitting of the image when the toner is softened and becomes sufficiently sticky to adhere to the surface of the fuser member which results in a partial or ghost image on the fuser member, the next sheet or the pressure roll, producing what is referred to as an offset image. Therefore, the release property is a function of the offset image, and the higher the temperature of the fuser member before hot offsetting occurs, the better the release properties of the particular mode. Furthermore, the greater fusing latitude, that is the temperature at which the toner begins to fuse up to the temperature at which hot offset occurs, is also a function of the release properties of the polymer release material containing reactive functionality and the metal of the fuser member. This fusing latitude, that is, the temperature range at which the fusing member can operate and including the temperature from which the toner begins to fuse up to the temperature where hot offset begins to occur, is also known as the fusing window of the fuser member. The fusing latitude is unexpectedly improved when copper-containing alloys are used as the working surface over comparable copper-free alloys.

The copper-containing alloys found most useful as working surfaces on fuser members include copper-/aluminum, copper/zinc (brass), copper/tin (bronze), copper/beryllium, copper/nickel, copper/iron, copper/molybdenum, and the like. All of these alloys are characterized by their ability to interact with the polymer release materials having reactive functionality, and thus, they are deemed chemically reactive. Other copper-containing alloys which are chemically reactive may also be used including the alloys of copper and other alloys, such as a copper/triballoy alloy. However, copper-containing alloys which are generally known as corrosion resistant alloys (non-oxidizing alloys) and do not have the ability to interact with the polymer release materials are outside the scope of this invention, for example, stainless steel/copper alloy, Monel (nickel/-copper/iron/manganese/carbon) and the like, do not release the molten or heated toner used in this invention.

Generally, it is preferred to use the copper-containing alloy only on the surface of the fuser member to obtain maximum thermal conductivity, especially in those fuser member modes where the heat is supplied by means located in the core of the fuser member. In those modes where maximum thermal conductivity is required in the fuser member, the base element of the fuser member, that is the core, is preferably made of a material which has high thermal conductivity such as copper, aluminum and the like. In these modes, a sheath of the metal alloy can be placed over the base member to provide a surfacce of the metal alloy. The sheath or outer metal alloy surface can be plated (e.g., by electroplating) on the base member placed upon the base member as a sleeve, welded on the base member as a plate, flame sprayed on the base member, co-extruded around a core, and the like.

The hardness of the copper-containing alloys contributes to the value of copper-containing alloys as surface materials for fuser members. Typically, copper has a hardness of Rockwell B40 ($R_B$ 40). The life of fuser members having copper surfaces is relatively short because of the softness of the copper. Wear caused by paper and auxiliary copier devices such as stripper fingers, pressure rolls and the like reduce the life of copper fuser members. However, the copper-containing alloys are substantially harder than copper, and resist wear normally encountered upon the sufaces of fuser members. Bronze has a typical hardness of about $R_B$70; brass has a hardness of between about $R_B$ 55 and $R_B$ 82 depending upon the treatment of the alloy and beryllium/-copper alloy has a hardness of about $R_B$50. Beryllium/-copper in a hardened state has a hardness of $R_C$36–40.

Although the copper-containing alloys have substantially improved hardness over the copper when used as a surface on fuser members, it was found that the copper-containing alloys also have unexpectedly high fusing windows when used on fuser members in an actual fusing assembly. It was found that such copper-containing alloys have fusing windows often reaching in excess of 400° F when used in a fusing assembly. Thus, although the hardness of the fuser member is substantially improved when the copper-containing alloys are used upon the surfaces of fuser member thereby reducing wear rate, there is little or no sacrifice in the fusing window normally attainable with copper.

The following examples further define, describe and compare exemplary materials, both alloys and non-alloys, as bare metal surfaces of heated fuser members in an electrostatic reproducing apparatus using various polymer release materials having reactive functionality as release agents to reduce toner offset on the fuser member surface. Parts and percentages are by weight unless otherwise indicated. Hardness is in Rockwell hardness unless otherwise specified. The examples are also intended to illustrate the various preferred embodiments of the present invention.

Testing of bare metal rolls was carried out in a device similar to the fuser assembly shown in U.S. Pat. No. 3,937,637. The fusing fixture had 2 inch outside diameter rolls with release fluid confined in a 5 ml. sump. Copies were run at 10° intervals from 280° F. to release failure (offset) followed by a decrease in temperature. Two types of offset were observed:

1. Offset to the fuser roll which was removed by the metering blade.
2. Offset to the fuser roll which passed by the metering blade and printed out on subsequent copies.

Offset of type (1) is toner related where the adhesion forces between toner and surface exceed the cohesive forces of the toner at the rates involved. The toner is not considered to penetrate to the metal surface. Measurements of gloss versus temperature showed this failure to occur over approximately the same temperature range. This is characterized as offset to the roll.

Type (2) offset occurs when the toner penetrates to the metal surface. The adhesion forces are high and the toner is not removed by the metering blade. The temperature at which type (2) offset is observed is a function of release agent and metal substrate. For comparison purposes, the temperature at which type (2) offset is observed has been used to rank substrate performance. This is characterized as offset to the next copy.

One preferred mode of applying the polymer release materials on the fuser member includes a sump containing the release material positioned in such a manner that the fuser member surface passes through a part of the sump. A metering blade, mounted on the sump, contacts the fuser member and serves as a metering means to control the thickness of the release layer on the fuser member as the fuser member surface is withdrawn from or emerges from the sump. This mode is described in U.S. Pat. No. 3,937,637 and was used for the test fixture of Examples I and II below. Another preferred mode of application of the release material to the fuser member surface is a wick or pad which contacts the fuser member surface. This mode is described in U.S. Pat. No. 3,831,553. A wick was used as a release material applicator in Example III below. Other applicators for placing the release material on the fuser member include means for spraying, sponge-like pads, extruding means which extrude a film, a brush comprising fibers or bristles of the release material, or a brush or bristle containing the release material, a fluid soaked roll, and the like.

EXAMPLE I

Various metal surfaces were used in test fixtures described above. The polymer release material was a mercapto-functional polyorganosiloxane having 0.08 weight percent mercapto (SH) functionality. The various metals are listed in Table I below. The form of the surface employed upon the fuser roll is shown in the table where T represents a tube of metal, E represents electroplate, F represents flame spray and P represents plasma spray. Hot offset (1) and Hot offset (2) are described above. The toner material was a conventional thermoplastic resin toner known as Xerox Corp. 364 toner and comprises a copolymerized mixture of styrene and about 25 percent propyl methacrylate ester having carbon black pigment.

TABLE I

| | Metal/Alloy | Hot Offset (2) | Hot Offset (1) | Surface Form |
|---|---|---|---|---|
| | | ° F. | ° F | |
| | Copper | 450 | 350 | T |
| 75/25 | Copper/Aluminum | 375 | 350 | F |
| 50/50 | Copper/Iron | 330 | — | F |
| 50/50 | Copper/Nickel | 320 | 300 | F |
| 50/50 | Copper/Triballoy | 360 | 345 | P |
| 50/50 | Copper/Molybdenum | 370 | — | P |
| | Copper/Zinc (Brass) | 380 | 350 | E (T) |
| 88/12 | Copper/Tin (Bronze) | 400 | 350 | E (T) |
| | *Copper/Beryllium | 380 | 340–350 | I |

*1.4 weight percent beryllium

EXAMPLE II

Using the test fixture described above and a polymer release material identified as 8020 polyethylene comprising 80 parts BARECO 1000 polyethylene and 20 parts Allied Chemical AC8, toner material as described in Example I above was fused and hot offset temperatures were observed. Hot offset is shown below in Table II for various alloys where offset is the type where the hot offset appears on the next copy.

TABLE II

| | Metal/Alloy | Hot Offset (2) ° F | Surface Form |
|---|---|---|---|
| | Copper | 330 | E |
| 75/25 | Copper/Aluminum | 330 | F |
| 50/50 | Copper/Iron | 330 | F |
| 50/50 | Copper/Nickel | 340 | F |
| 50/50 | Copper/Triballoy | 330 | P |
| 50/50 | Copper/Molybdenum | 330 | P |
| | Copper/Zinc (Brass) | 340 | E (T) |
| 88/12 | Copper/Tin (Bronze) | 325 | E (T) |
| * | Copper/Beryllium | 300 | T |

*1.4 weight percent beryllium

EXAMPLE III

Nickel, brass, bronze and beryllium/copper fuser rolls were used in the fuser assembly of a conventional high speed xerographic copier/duplicator using a mercapto functional polyorganosiloxane fluid as a release agent on the particular bare metal roll being tested. Long copy runs (in excess of 250,000 copies fused) and release testing confirmed the good performance of brass, bronze and beryllium/copper metals. Nickel fuser rolls failed because of poor release. The table below (TABLE III) characterizes these alloys and compares them with copper.

TABLE III

PROPERTIES OF COPPER, BRASS, BRASS, BRONZE AND BERYLLIUM COPPER

| | Copper | Brass (alloy 260) | Brass (alloy 524) | Be/Cu |
|---|---|---|---|---|
| Release | Excellent | Excellent | Excellent | Excellent |
| Hardness* (diamond pyramid) | 70–100 | 70–150 | 100–200 | 120–380 |
| Thermal conductivity BTR $hr^{-1}ft^{-2}$ $(° F/ft)^{-1}$ | 226 | 70 | 29 | 70 |

*depends on heat-treatment.

In accordance with the stated objects, bare metal fuser members for pressure fixing toned electrostatic images at elevated temperatures wherein the fuser member has improved resistance to wear and unexpected release properties when used with polymer release materials having reactive functionality, have been demonstrated.

While the invention has been described with respect to preferred embodiments, it will be apparent that certain modifications and changes can be made without departing from the spirit and scope of the invention and therefore, it is intended that the foregoing disclosure be limited only by the claims appended hereto.

What is claimed is:

1. A bare metal fuser member for pressure fusing toned electrostatic images at elevated temperatures, the fuser member having improved resistance to wear and using polymer release materials having reactive functionality with the metal of the fuser member to reduce toner offset comprising a base member having a working surface of hard, abrasion resistant metal alloy, said metal alloy being the type which is chemically reactive and thereby permits the formation of a barrier layer when polymer release materials having reactive functionality are used thereon.

2. The bare metal fuser member of claim 1 wherein the metal alloy is a copper-containing alloy.

3. The bare metal fuser member of claim 2 wherein the copper-containing alloy is copper/aluminum.

4. The bare metal fuser member of claim 2 wherein the copper-containing alloy is copper/zinc (brass).

5. The bare metal fuser member of claim 2 wherein the copper-containing alloy is copper/tin (bronze).

6. The bare metal fuser member of claim 2 wherein the copper-containing alloy is copper/beryllium.

7. The bare metal fuser member of claim 2 wherein the copper-containing alloy is copper/nickel.

8. The bare metal fuser member of claim 1 further comprising a metal alloy which is substantially thermally conductive.

9. A bare metal roll for pressure fusing toned electrostatic images at elevated temperatures, the bare metal roll having improved resistance to wear and using fluid polymer release materials having reactive functionality with the metal of the roll to reduce toner offset comprising a cylindrical member having a working surface of hard, abrasion resistant, chemically reactive copper-containing alloy, the chemical reactivity of the copper-containing alloy being sufficient to permit the formation of a barrier layer when the fluid polymer release material having reactive functionality is used thereon.

10. The bare metal fuser roll of claim 9 further comprising a copper-containing alloy which is substantially thermally conductive.

11. The bare metal fuser roll of claim 9 wherein the copper-containing alloy is copper/aluminum.

12. The bare metal fuser roll of claim 9 wherein the copper-containing alloy is copper/zinc (brass).

13. The bare metal fuser roll of claim 9 wherein the copper-containing alloy is copper/tin (bronze).

14. The bare metal fuser roll of claim 9 wherein the copper-containing alloy is copper/beryllium.

15. The bare metal fuser roll of claim 9 wherein the copper-containing alloy is copper/nickel.

* * * * *